US009677390B2

(12) United States Patent
Christensen

(10) Patent No.: US 9,677,390 B2
(45) Date of Patent: Jun. 13, 2017

(54) RECIPROCATING PUMP DRIVE ASSEMBLY

(71) Applicant: Amik Oilfield Equipment and Rentals Ltd., Lloydminster (CA)

(72) Inventor: Corey Christensen, Lloydminster (CA)

(73) Assignee: AMIK OILFIELD EQUIPMENT AND RENTALS LTD., Lloydminster, B.C. (CA)

( * ) Notice: Subject to any disclaimer, the term of this patent is extended or adjusted under 35 U.S.C. 154(b) by 201 days.

(21) Appl. No.: 14/560,860

(22) Filed: Dec. 4, 2014

(65) Prior Publication Data

US 2016/0160597 A1 Jun. 9, 2016

(51) Int. Cl.
*E21B 43/12* (2006.01)

(52) U.S. Cl.
CPC ..... *E21B 43/126* (2013.01)

(58) Field of Classification Search
CPC . E21B 43/126; E21B 2043/125; E21B 43/127
USPC ..... 166/75.11, 72
See application file for complete search history.

(56) References Cited

U.S. PATENT DOCUMENTS 4,497,616 A * 2/1985 Ratell, Jr. ..... F04B 47/04 417/390
2006/0045769 A1* 3/2006 Montgomery ..... F04B 17/042 417/415
2010/0310385 A1* 12/2010 Denne ..... E21B 43/127 417/53

* cited by examiner

*Primary Examiner* — Taras P Bemko
(74) *Attorney, Agent, or Firm* — Ryan W. Dupuis; Kyle R. Satterthwaite; Ade & Company Inc.

(57) ABSTRACT

A reciprocating pump drive assembly for driving a reciprocation of a polish rod relative to a well casing includes a support frame which supports a pair of hydraulic actuators such that the cylinder portions thereof are fixed relative to the well casing. A mounting frame is supported at a top end thereof on the top ends of the piston portions of the hydraulic actuators so as to extend downwardly to a polish rod mounting bracket at the bottom end of the mounting frame. The top end of the polish rod is thus supported by the mounting frame so as to be suspended below the top end of the hydraulic actuators for improved access during servicing and for greater overall lateral stability of the drive assembly.

15 Claims, 4 Drawing Sheets

RECIPROCATING PUMP DRIVE ASSEMBLY

FIELD OF THE INVENTION

The present invention relates to reciprocating pump drive assembly for driving a reciprocating pump of the type including a polish rod arranged to be reciprocated relative to a surrounding oil well casing, and more particularly the present invention relates to a reciprocating pump drive assembly which includes a pair of linear hydraulic actuators connected to the polish rod through a suitable mounting frame to drive reciprocating of the polish rod by extension and retraction of the linear hydraulic actuators.

BACKGROUND

The use of reciprocating pumps is well known in oil production wells. They generally consist of a polish rod which is longitudinally reciprocated within a pump casing mounted in series with an outer casing in the well. The polish rod cooperates with suitable check valves in the pump casing which serve to pump liquids to the surface of the well through the outer casing of the well. A drive unit is typically provided at the well head which serves to reciprocate the polish rod relative to the well casing.

Drive units commonly make use of linear hydraulic actuators coupled to the polish rod by various means. Typically, the cylinder end of the actuator is arranged to be fixed relative to the wellhead and the piston of the actuator is anchored relative to the polish rod such that extension and retraction of the linear hydraulic actuator results in a corresponding reciprocation of the polish rod relative to the well casing. Hydraulic actuators however are primarily designed with their linear extension force in mind, rather than lateral stability transverse to the direction of extension. When used for reciprocating a polish rod, the weight of the polish rod string can place considerable off-axis stresses on the actuators which might result in premature wear, or failure in some instances. Furthermore, due to the long stroke length of polish rod configurations, the connection of the polish rod to the actuators is necessarily at a high location above the wellhead which can be difficult or potentially unsafe to access for maintenance and the like.

SUMMARY OF THE INVENTION

According to one aspect of the invention there is provided a reciprocating pump drive assembly for driving a reciprocating pump including a polish rod arranged to be reciprocated longitudinally relative to a surrounding oil well casing, the reciprocating pump drive assembly comprising:

- a support frame arranged to be mounted in fixed relation relative to the well casing;
- a pair of hydraulic actuators, each hydraulic actuator extending longitudinally between a lower portion coupled in fixed relation to the support frame and an upper portion which is longitudinally slidable relative to the lower portion so as to vary an overall height of the hydraulic actuator;
- a mounting frame supported on the upper portions of the hydraulic actuators; and
- a mounting bracket supported on the mounting frame and being arranged to support the polish rod thereon such that the polish rod is reciprocated relative to the well casing together with reciprocation of the upper portions of the hydraulic actuators relative to the lower portions of the hydraulic actuators;

- the mounting bracket being supported on the mounting frame at a location which is spaced downwardly relative to a top end of the hydraulic actuators such that a top end of the polish rod is supported below the top end of the hydraulic actuators.

By providing a mounting frame which depends downwardly from the connection to the hydraulic actuators, the resulting mounting bracket connection to the polish rod can be recessed in elevation relative to the top end of the actuators. This results in an easier and safer access to the polish rod connection for maintenance. More importantly, the lower elevation on the polish rod connection provides a more stable support of the polish rod such that any off-axis load from the polish rod is accordingly at a lower elevation relative to the hydraulic actuators which in turn reduces any off-axis stresses of the piston relative to the cylinder of the hydraulic actuator. The reduced stresses minimize the potential for premature wear of the actuators.

Preferably the mounting frame is substantially fully received between the pair of hydraulic actuators, and is substantially fully supported within a common plane locating the pair of hydraulic actuators and the polish rod therein.

Preferably a top end of the mounting frame is supported on the top end of the upper portions of the hydraulic actuators and the mounting bracket supporting the top end of the polish rod therein is located at a bottom end of the mounting frame.

The mounting frame may further include a cross member spanning between the upper portions of the hydraulic actuators at a top end of the mounting frame and a pair of depending legs extending downwardly from the cross member at the top end of the mounting frame to the mounting bracket which spans between the depending legs at the bottom end of the mounting frame. Preferably the mounting bracket is arranged to support the polish rod at a central location thereon between the depending legs.

Preferably the lower portion of each hydraulic actuator comprises a cylinder portion and the upper portion of each hydraulic actuator comprises a piston portion which is slidably received within the respective cylinder portion.

The mounting frame preferably spans a prescribed height between the top end of the piston portion and the mounting bracket supporting the polish rod thereon which is greater than half a height of the cylinder portions. Accordingly, the mounting bracket is closer to a top end of the lower portions of the hydraulic actuators in a fully extended position of the hydraulic actuators than in a fully retracted position of the hydraulic actuators.

The support frame preferably includes a base member at a bottom end of the support frame which includes a plurality of circumferentially spaced apart mounting apertures therein which are adapted to be mounted to a bolt flange of a casing joint of the well casing using threaded fasteners.

The support frame may further comprise: i) a base member at a bottom end of the support frame which mounts a bottom end of each cylinder portion thereon such that the hydraulic actuators lie in a first common plane, the base member including a central opening therein which is arranged to receive the polish rod therethrough; ii) a pair of posts extending upwardly from the base member in a second common plane which is parallel and spaced apart from the first common plane; and iii) a top member spanning across a top end of the cylinder portions and a top end of the posts, the top member including a central opening therein which receives the mounting frame slidably therethrough.

The support frame may yet further comprise: iv) a mounting collar clamped about the cylinder portion of each hydraulic actuator, and a brace arm mounted between each mounting collar and a respective one of the posts.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
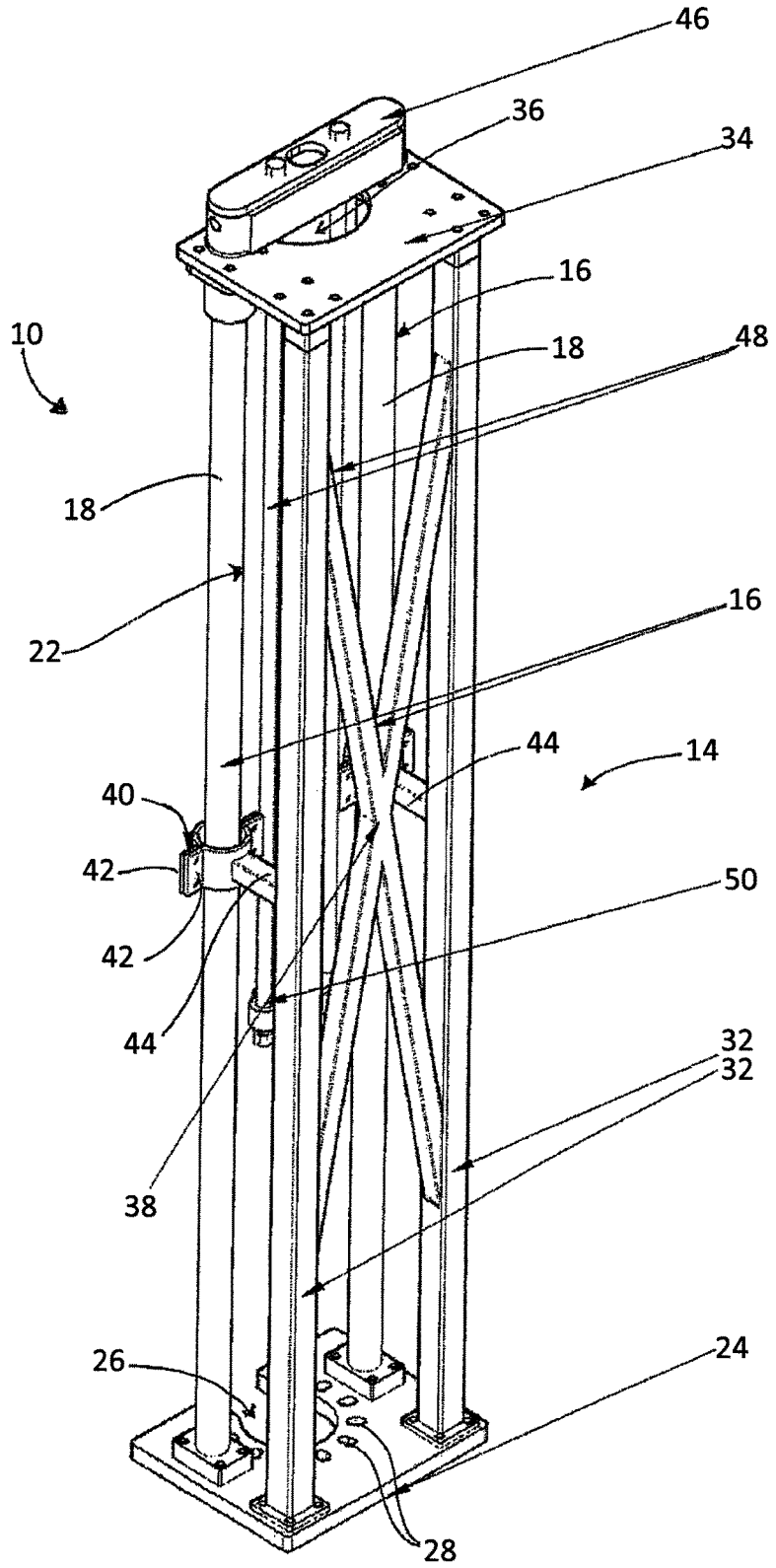
FIG. 1 is a perspective view of the reciprocating drive assembly.
Figure 2:
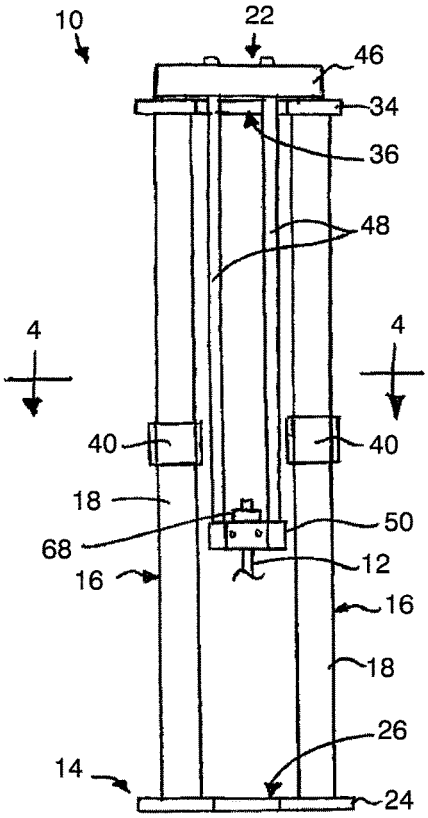
FIG. 2 is a front elevational view of the reciprocating drive assembly in a lowered position.
Figure 4:
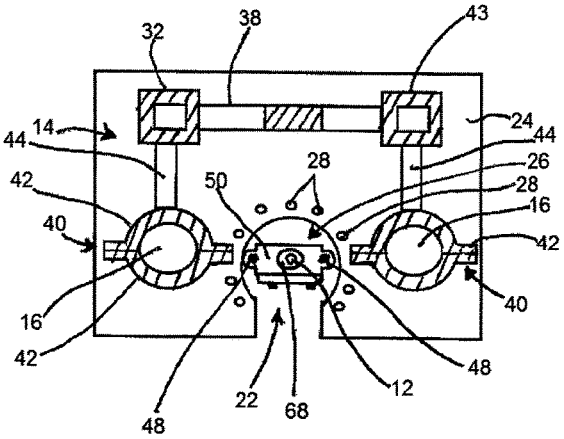
FIG. 4 is a sectional view along the line 4-4 in FIG. 2.
Figure 3:
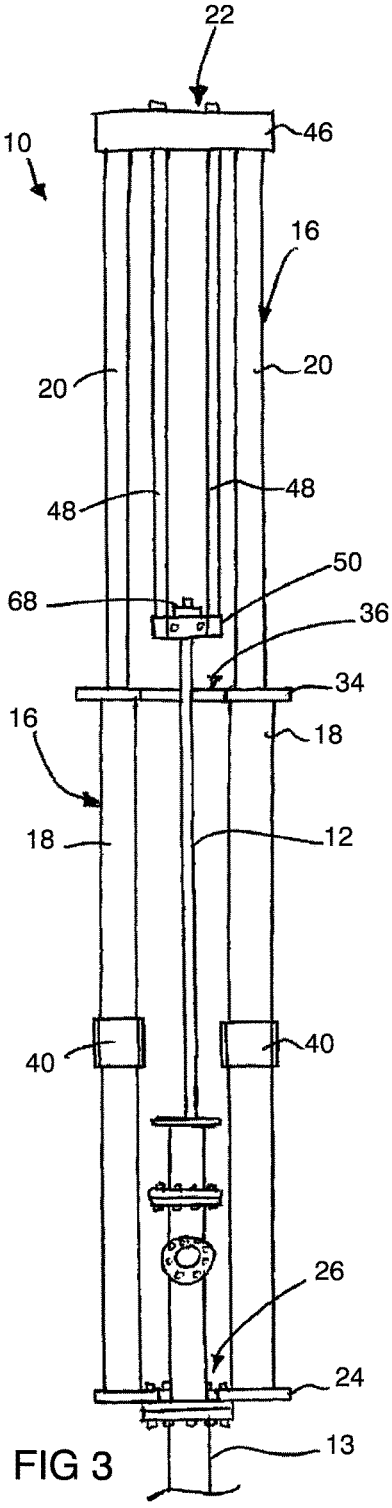
FIG. 3 is a front elevational view of the reciprocating drive assembly in the raised position.
Figure 5:
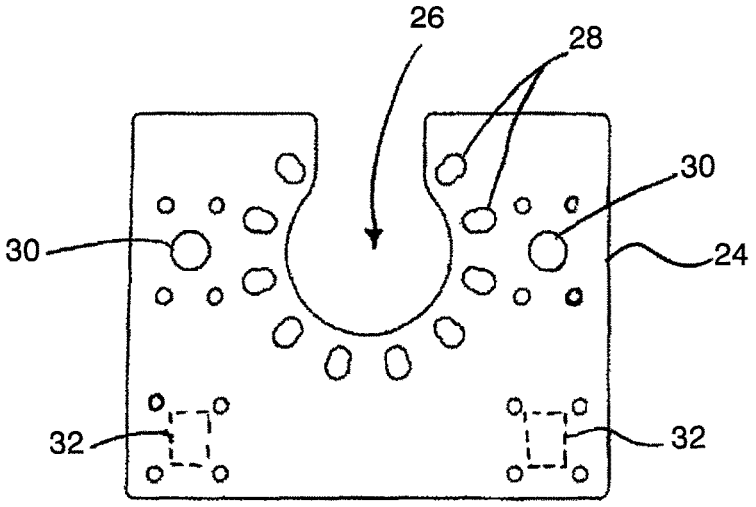
FIG. 5 is a plan view of the base plate of the reciprocating drive assembly.
Figure 6:
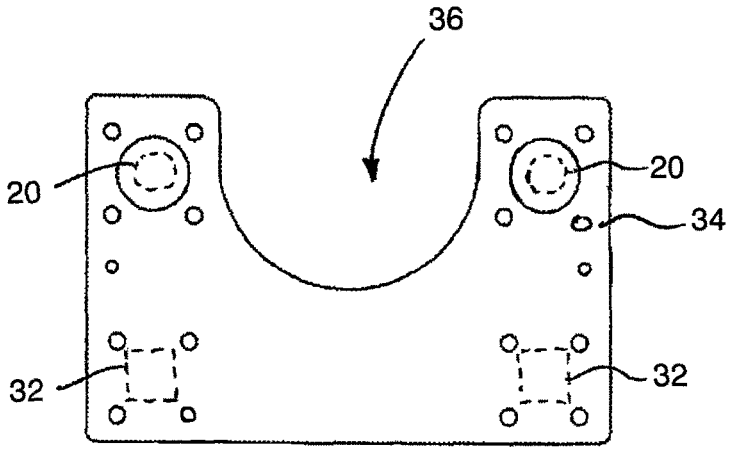
FIG. 6 is a plan view of the top plate of the reciprocating drive assembly.
Figure 7:
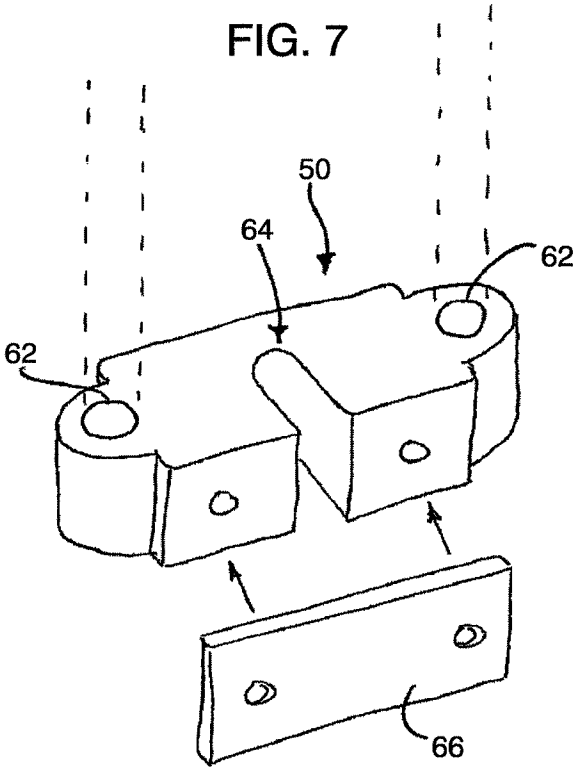
FIG. 7 is a perspective view of the mounting bracket at the bottom end of the mounting frame of the reciprocating drive assembly.
Figure 9:
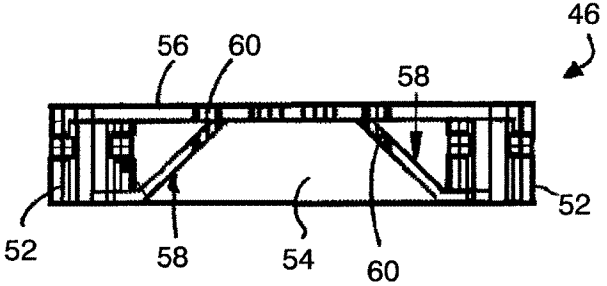
FIG. 9 is a sectional view along the line 9-9 in FIG. 8.
Figure 8:
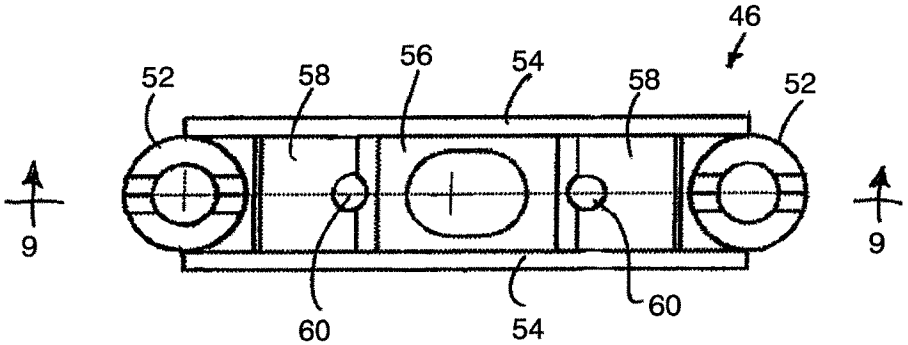
FIG. 8 is a bottom plan view of the cross member at the top end of the mounting frame of the reciprocating drive assembly.

Referring to the accompanying figures, there is illustrated a reciprocating pump drive assembly generally indicated by reference numeral 10. The assembly 10 is particularly suited for use with a reciprocating pump of the type including a polish rod 12 arranged to be reciprocating relative to a pump casing locating various check valves therein for cooperation with the reciprocating polish rod to pump a fluid up through the well casing connected in series with the pump casing.

The assembly 10 generally includes a support frame 14 arranged to be mounted in fixed relation to the well casing. The assembly 10 further includes two hydraulic actuators 16 in which each actuator includes a cylinder portion 18, which is mounted in fixed relation on the support frame, and a piston portion 20 arranged to be reciprocated relative to the cylinder portion on the support frame. The assembly 10 yet further comprises a mounting frame 22 which is supported on the piston portions 20 of the hydraulic actuators for movement together therewith relative to the support frame. The mounting frame 20 serves to support the polish rod thereon such that extension and retraction of the hydraulic actuators 16 reciprocates the mounting frame and the polish rod supported thereon relative to the support frame 14 fixed to the well casing.

The support frame 14 includes a base plate 24 in the form of a rectangular flat metal plate locating a central opening 26 therein which is suitably sized to receive the polish rod axially therethrough. The central opening 26 is open to one side edge of the plate such that the base plate is generally U-shaped in configuration. A plurality of bolt apertures 28 are provided at evenly spaced positions in the circumferential direction about the rim of the central opening 26 so as to be evenly spaced about a portion of the circumference around the polish rod received through the base plate in operation. The bolt apertures are arranged for alignment with corresponding fastener locations of a plurality of bolts used to connect corresponding bolt flanges of a casing joint of the well casing.

A base plate 24 further includes two mounting apertures 40 formed therein at diametrically opposed sides of the central opening 26. Each mounting aperture defined a mounting location for the cylinder end of a respective one of the pair of actuators 16. The hydraulic actuators are mounted to extend vertically upward from the base plate 24 at the two mounting apertures 30. The actuators 16 are situated parallel and spaced apart from one another so as to be vertically oriented in a common plane with the polish rod received centrally therebetween.

The support frame further includes two posts 32 which also extend vertically upward from the base plate so as to be parallel and spaced apart from one another. The two posts 32 lie in a respective common plane which is parallel to and spaced apart from the common plane locating the two actuators 16 therein. The two actuators and the two posts 32 are arranged in a rectangular configuration relative to one another in proximity to the four corners of the rectangular base plate respectively. The two posts are substantially equal in height to the cylinder portions 18 of the two actuators respectively.

A top plate 34 is joined between the top ends of the two posts and the two cylinder portions of the actuators so as to be oriented generally horizontally and parallel to the base plate at a top end of the support frame. The top plate also includes a central opening 36 formed therein which is opened to one side edge of the generally rectangular rigid plate forming the top plate such that the top plate is also generally U-shaped in configuration similarly to the base plate. The central opening 36 is suitably sized to receive the mounting frame 22 sliding longitudinally therethrough as described in further detail below.

The support frame further includes two cross members 38 arranged in an X-shaped intersecting manner in connection between the two posts 32 so as to lie in a substantially common plane therewith. The cross members 38 function as struts of a truss formed between the two posts to add structural support to the support frame.

Additional support between the cylinder portions between the hydraulic actuators and respective ones of the two posts are provided using two mounting collars 40 secured about the two cylinder portions 18 respectively. Each mounting collar is mounted by being clamped about the circumference of a respective one of the cylinder portions at a central location along the height thereof. More particularly, each mounting collar comprises two semi-circular clamping members 42 having fastener flanges at diametrically opposed sides thereof so that the two clamping members can be fastened together at the fastening flanges using suitable threaded fasteners to frictionally clamp the respective cylinder portion therein.

An innermost one of the clamping members 42 of each mounting collar is fixed by welding to a respective brace arm 44 extending horizontally from the mounting collar to a respective one of the posts 32 to which it is fixed also by welding. Releasing the fasteners between the clamping members of each mounting collar permits the respective hydraulic actuator to be released from the support for servicing if required, despite one of the clamping members 42 and the brace arm 44 to which it is fixed remaining fixed to the post of the support frame.

The mounting frame 22 of the assembly 10 includes a cross member 46 which is mounted to span horizontally between the top ends of the piston portions 20 of the two hydraulic actuators 16 respectively. More particularly the cross member 46 is joined between the piston portions of the two hydraulic actuators above the top plate 34. In the retracted and lowermost position of the drive assembly, the cross member 46 is located directly against a top side of the top plate 34 at the top end of the support frame 14. As the piston portions 20 are extended to their fully extended position, corresponding to the raised position of the pump drive assembly, the cross member 46 is spaced above the top plate with the remainder of the mounting frame extending vertically downward therefrom for connection to the top end of the polish rod at a location spaced well below the cross member 46 in proximity to the top plate 34.

The mounting frame further includes two depending legs 48 which are mounted to the cross member at laterally spaced apart positions on diametrically opposed sides of the vertical axis of the polish rod. The two depending legs 48 span the full vertical height of the mounting frame from respective top ends fixed onto the cross member to respective bottom ends fixed onto laterally opposing ends of a suitable mounting bracket 50. The mounting bracket 50 at the bottom end of the mounting frame couples the top end of the polish rod thereto.

The two depending legs are thus supported so as to be vertically oriented, parallel and spaced apart from one another, within a common plane of the two actuators 16 and the polish rod therebetween. The two depending legs of the mounting frame are arranged to be fully received in the lateral direction between the two hydraulic actuators 16 while remaining at diametrically opposed sides of the polish rod similarly to the two actuators.

The length of the depending legs is slightly more than half of the vertical length of the cylinder portions of the hydraulic actuators so as to be near in length to the stroke length of the piston portions relative to the cylinder portions.

The cross member 46 is formed to include two mounting collars 52 at laterally opposed ends thereof having respective axes which are vertically oriented for receiving the top end of the piston portions of the two actuators therein respectively. Each collar 52 includes a transverse opening therein for receiving a suitable bolt or pin for securement to the piston portion 20 of the respective actuator.

The cross member 46 is further formed by two side plates 54 and a top plate 56 connected laterally between the two collars to generally define a horizontal beam structure between the collars. The top plate 56 is horizontal across the top end of the cross member while the two side plates 54 are parallel and spaced apart along opposing sides of the cross member to depend downwardly from the opposing side edges of the top plate. Two angle braces 58 are mounted internally between the two side plates so as to form respective gussets between the top plate and the two collars 52 respectively.

A pair of vertically oriented mounting bores 60 are provided through the top plate and the angle brace plates therebelow for receiving the top ends of the two depending legs therethrough. The depending legs each comprise a rigid rod which can be secured by threaded fasteners or welding and the like to the cross member 46 when received within the two vertical mounting bores 60 respectively.

The mounting bracket 50 comprises a solid rigid metal block also locating two mounting bores 62 therein such that the bores are vertically oriented, parallel and spaced apart from one another for alignment with the two mounting bores 60 of the cross member respectively. The mounting bores 62 of the mounting bracket are thus arranged to receive the bottom ends of the two legs 48 respectively therethrough. Again, the legs may be secured using threaded fasteners or by welding and the like. The two mounting bores 62 of the mounting bracket are located at the laterally opposing ends of the block such that the overall width of the block is only slightly greater than the overall width of the mounting frame as defined by the depending legs 48. Furthermore, the block is arranged to be received through the central opening in the top plate to permit extension of the mounting bracket above the top plate in the fully extended and raised position of the pump drive assembly.

The block forming the mounting bracket 50 also includes a central opening 64 formed therein having a suitable dimension to receive the polish rod extending vertically therethrough. The central opening is open to one side of the block to form a slot permitting the polish rod to be slidably inserted into the central opening from the side of the block. A retainer plate 66 of rigid metal is arranged to span one side of the block forming the mounting bracket to selectively enclose the slotted side opening of the central opening 64 to selectively retain the polish rod within the central opening as desired. A pair of apertures in the retainer plate and the corresponding side of the block permit suitable fasteners to selectively retain the plate in a mounted position on the block as desired. The top side of the mounting bracket comprises a flat horizontal surface. Typically the polish rod is mounted to protrude upwardly through the central opening such that a suitable retainer 68 such as a nut, flange or other portion of increased diameter provided at the top end of the polish rod can be abutted with the top surface of the mounting bracket to suspend the polish rod therefrom.

The pump drive assembly is mounted to a well casing by mounting the base plate of the support frame to a bolt flange of a casing joint at the well head of a well. The polish rod is supported to extend vertically upward through the central opening for securement at the top end thereof to the mounting bracket 50 at the bottom end of the depending mounting frame as described above. A suitable hydraulic supply with supply and return lines are coupled to the cylinder portions of the two hydraulic actuators in a conventional manner to drive reciprocation of the piston portions relative to the cylinder portions of the hydraulic actuators.

The actuators are reciprocated between a lowest position and an uppermost position. The lowest position corresponds to full retraction of the piston portions within the cylinder portions of the actuators such that the top cross member is located directly against the top side of the top plate of the support frame with the mounting frame being fully recessed relative to the top end of the support frame. In this instance, the mounting bracket at the bottom of the mounting frame which mounts the top end of the polish rod therein is located closer to the bottom end than the top end of the support frame. As shown in the figures, each hydraulic actuator thus extends between a lower portion coupled in fixed relation to the support frame which defines a bottom end of the hydraulic actuator and an upper portion which defines a top end of the hydraulic actuator at a location spaced above the bottom end of the hydraulic actuator so as to vary an overall height of the hydraulic actuator between the top and bottom ends of the hydraulic actuator. Furthermore as shown in the figures, the mounting frame is supported on the upper portions of the hydraulic actuators at a connection between the mounting frame and the upper portions of the hydraulic actuators so as to depend downwardly from said connection such that the mounting bracket supported on the mounting frame is at a location which is spaced downwardly relative to said connection and such that a top end of the polish rod is supported at a location which is spaced below the top ends of the hydraulic actuators in fixed relation to the top ends of the hydraulic actuators, between the top ends and the bottom ends of the hydraulic actuators.

In the opposing uppermost position of the drive assembly, the actuators are fully extended such that the mounting frame is located substantially fully above the top plate of the support frame with the mounting bracket securing the top end of the polish rod thereon being located in proximity to or above the top plate of the support frame. Any off-axis stresses by the polish rod on the drive assembly tend to be accommodated for by the mounting frame so as to minimize off-axis stresses on the piston portions relative to the cylinder portions of the hydraulic actuators. Furthermore, in the lowered position, access to the connection of the polish rod to the mounting bracket is provided at a relatively low elevation nearer to the bottom end of the support frame than the top end thereof.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A reciprocating pump drive assembly for driving a reciprocating pump including a polish rod arranged to be reciprocated longitudinally relative to a surrounding oil well casing, the reciprocating pump drive assembly comprising:

a support frame arranged to be mounted in fixed relation relative to the well casing;

a pair of hydraulic actuators, each hydraulic actuator extending longitudinally between a lower portion coupled in fixed relation to the support frame which defines a bottom end of the hydraulic actuator and an upper portion which defines a top end of the hydraulic actuator at a location spaced above the bottom end of the hydraulic actuator and which is longitudinally slidable relative to the lower portion so as to vary an overall height of the hydraulic actuator between the top and bottom ends of the hydraulic actuator;

a mounting frame supported on the upper portions of the hydraulic actuators at a connection between the mounting frame and the upper portions of the hydraulic actuators so as to depend downwardly from said connection; and a mounting bracket supported on the mounting frame and being arranged to support the polish rod thereon such that the polish rod is reciprocated relative to the well casing together with reciprocation of the upper portions of the hydraulic actuators relative to the lower portions of the hydraulic actuators;

the mounting bracket being supported on the mounting frame at a location which is spaced downwardly relative to the connection between the mounting frame and the upper portions of the hydraulic actuators such that a top end of the polish rod is supported at a location which is spaced below the top ends of the hydraulic actuators in fixed relation to the top ends of the hydraulic actuators, between the top ends and the bottom ends of the hydraulic actuators.

2. The assembly according to claim 1 wherein the mounting frame is substantially fully received between the pair of hydraulic actuators.

3. The assembly according to claim 1 wherein the mounting frame is substantially fully supported within a common plane locating the pair of hydraulic actuators therein.

4. The assembly according to claim 1 wherein the mounting frame is substantially fully supported within a common plane within which the polish rod is arranged to be located.

5. The assembly according to claim 1 wherein the mounting bracket is located at a bottom end of the mounting frame.

6. The assembly according to claim 1 wherein a top end of the mounting frame is supported on the top ends of the hydraulic actuators.

7. The assembly according to claim 1 wherein the mounting frame comprises a cross member spanning between the upper portions of the hydraulic actuators defining said connection between the mounting frame and the upper portions of hydraulic actuators at a top end of the mounting frame and a pair of depending legs extending downwardly from the cross member at the top end of the mounting frame to the mounting bracket which spans between the depending legs at the bottom end of the mounting frame.

8. The assembly according to claim 7 wherein the mounting bracket is arranged to support the polish rod at a central location thereon between the depending legs.

9. The assembly according to claim 1 wherein the lower portion of each hydraulic actuator comprises a cylinder portion and the upper portion of each hydraulic actuator comprises a piston portion which is slidably received within the respective cylinder portion, the mounting frame spanning a prescribed height between the top end of the piston portion and the mounting bracket supporting the polish rod thereon which is greater than half a height of the cylinder portions.

10. The assembly according to claim 1 wherein the mounting bracket is closer to a top end of the lower portions of the hydraulic actuators in a fully extended position of the hydraulic actuators than in a fully retracted position of the hydraulic actuators.

11. The assembly according to claim 1 wherein the support frame includes a base member at a bottom end of the support frame which includes a plurality of circumferentially spaced apart mounting apertures therein which are adapted to be mounted to a bolt flange of a casing joint of the well casing using threaded fasteners.

12. The assembly according to claim 1 wherein the lower portion of each hydraulic actuator comprises a cylinder portion and the upper portion of each hydraulic actuator comprises a piston portion which is slidably received within the respective cylinder portion, the support frame comprising:

a base member at a bottom end of the support frame which mounts a bottom end of each cylinder portion thereon such that the hydraulic actuators lie in a first common plane, the base member including a central opening therein which is arranged to receive the polish rod therethrough;

a pair of posts extending upwardly from the base member in a second common plane which is parallel and spaced apart from the first common plane; and a top member spanning across a top end of the cylinder portions and a top end of the posts, the top member including a central opening therein which receives the mounting frame slidably therethrough.

13. The assembly according to claim 12 wherein the support frame further comprises a mounting collar clamped about the cylinder portion of each hydraulic actuator, and a brace arm mounted between each mounting collar and a respective one of the posts.

14. A reciprocating pump drive assembly for driving a reciprocating pump including a polish rod arranged to be reciprocated longitudinally relative to a surrounding oil well casing, the reciprocating pump drive assembly comprising:

a support frame arranged to be mounted in fixed relation relative to the well casing;

a pair of hydraulic actuators, each hydraulic actuator extending longitudinally between a lower portion coupled in fixed relation to the support frame and an upper portion which is longitudinally slidable relative to the lower portion so as to vary an overall height of the hydraulic actuator;

a mounting frame supported on the upper portions of the hydraulic actuators; and a mounting bracket supported on the mounting frame and being arranged to support the polish rod thereon such that the polish rod is reciprocated relative to the well casing together with reciprocation of the upper portions of the hydraulic actuators relative to the lower portions of the hydraulic actuators;

the mounting bracket being supported on the mounting frame at a location which is spaced downwardly relative to a top end of the hydraulic actuators such that a top end of the polish rod is supported below the top end of the hydraulic actuators;

the lower portion of each hydraulic actuator comprising a cylinder portion and the upper portion of each hydraulic actuator comprising a piston portion which is slidably received within the respective cylinder portion, and the support frame comprising:

a base member at a bottom end of the support frame which mounts a bottom end of each cylinder portion thereon such that the hydraulic actuators lie in a first common plane, the base member including a central opening therein which is arranged to receive the polish rod therethrough;

a pair of posts extending upwardly from the base member in a second common plane which is parallel and spaced apart from the first common plane; and a top member spanning across a top end of the cylinder portions and a top end of the posts, the top member including a central opening therein which receives the mounting frame slidably therethrough.

15. The assembly according to claim 14 wherein the support frame further comprises a mounting collar clamped about the cylinder portion of each hydraulic actuator, and a brace arm mounted between each mounting collar and a respective one of the posts.

* * * * *